US007322991B1

(12) United States Patent
Robinson

(10) Patent No.: US 7,322,991 B1
(45) Date of Patent: Jan. 29, 2008

(54) EYEBROW SHAPING DEVICE

(76) Inventor: Denise Robinson, 381D Park Ridge La., Aurora, IL (US) 60504

( * ) Notice: Subject to any disclaimer, the term of this patent is extended or adjusted under 35 U.S.C. 154(b) by 205 days.

(21) Appl. No.: 10/619,024

(22) Filed: Jul. 14, 2003

(51) Int. Cl.
*A61B 17/50* (2006.01)

(52) U.S. Cl. ..... 606/133; 606/134; 132/319

(58) Field of Classification Search ..... 606/132, 606/133, 134; 132/216, 285, 289, 319
See application file for complete search history.

(56) References Cited

U.S. PATENT DOCUMENTS 2,842,142 A 7/1958 Peck
2,917,058 A 12/1959 Ferrar
4,942,891 A 7/1990 Trevisan
5,186,190 A * 2/1993 Hirzel ..... 132/319
6,161,554 A * 12/2000 Dunlap-Harris ..... 132/216
6,336,462 B1 * 1/2002 Santelli et al. ..... 132/319

* cited by examiner

*Primary Examiner*—Kevin T. Truong

(57) ABSTRACT

A eyebrow shaping device for shaping eyebrows easily and in a consistent form. The eyebrow shaping device includes a plurality of pairs of forms defining various shapes and sizes of eyebrows. Each pair of forms comprises a right and a left template. Each form has a template portion with a cut-out defining the shape and size, a substrate portion distributed along a first surface of the template portion and designed for removing unwanted eyebrow hair, and a protective portion releasably coupled to the substrate portion for protecting the substrate portion until use.

2 Claims, 5 Drawing Sheets

EYEBROW SHAPING DEVICE

BACKGROUND OF THE INVENTION

1. Field of the Invention

The present invention relates to eyebrow stencils and more particularly pertains to a new eyebrow shaping device for shaping eyebrows easily and in a consistent form.

2. Description of the Prior Art

The use of eyebrow grooming devices is known in the prior art. Such prior art includes: U.S. Pat. No. 4,942,891; U.S. Pat. No. 2,917,058; and U.S. Pat. No. 2,842,142.

While these devices fulfill their respective, particular objectives and requirements, the need remains for a system and method creates uniform shaping of the eyebrows and does note require tweezing.

SUMMARY OF THE INVENTION

The present invention meets the needs presented above by providing a plurality of templates which may be applied by the user, maintained in position for a predetermined interval and removed, whereby unwanted hair is removed and the eyebrow is groomed to the shape of the template.

Another object of the present invention is to provide a new eyebrow shaping device that facilitates quick and efficient grooming of the user's eyebrows.

Still another object of the present invention is to provide a new eyebrow shaping device that can facilitate complex shaping of the user's eyebrows.

Even still another object of the present invention is to provide a new eyebrow shaping system which accommodates a wide variety of shapes and sizes.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
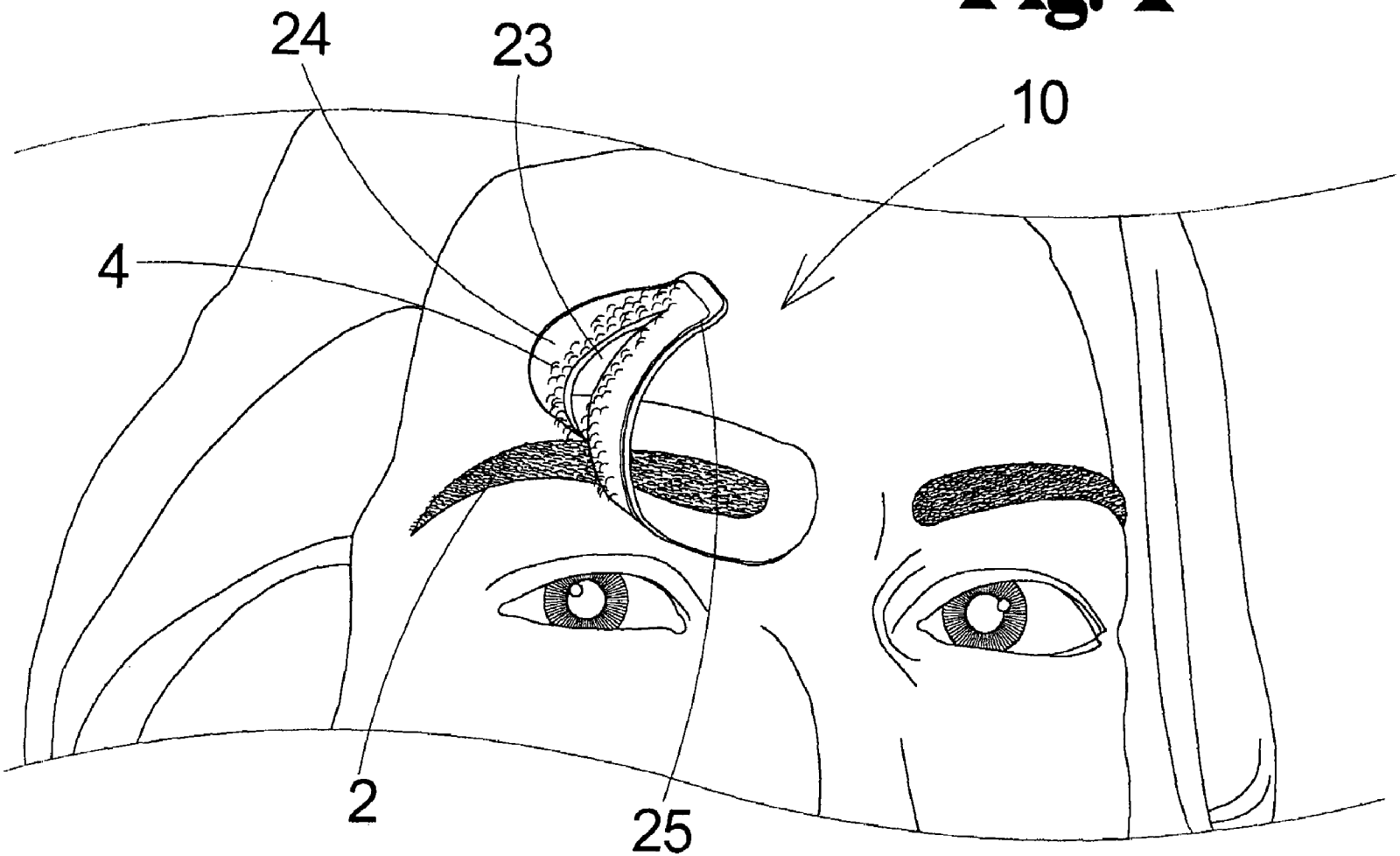
FIG. 1 is a schematic top perspective view of a new eyebrow shaping device being removed according to the present invention.
Figure 2:
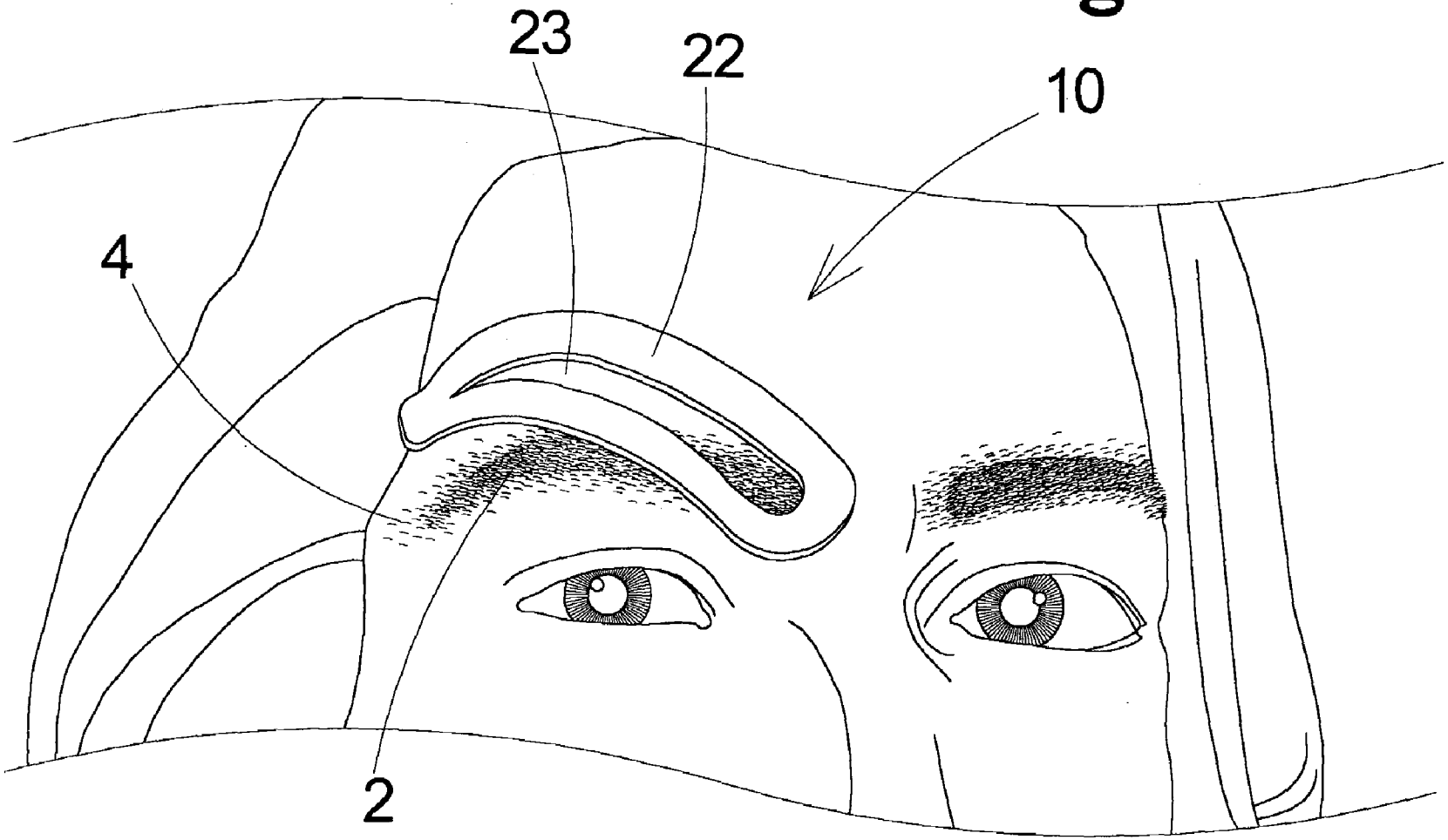
FIG. 2 is a schematic front view of the present invention being applied.
Figure 3:
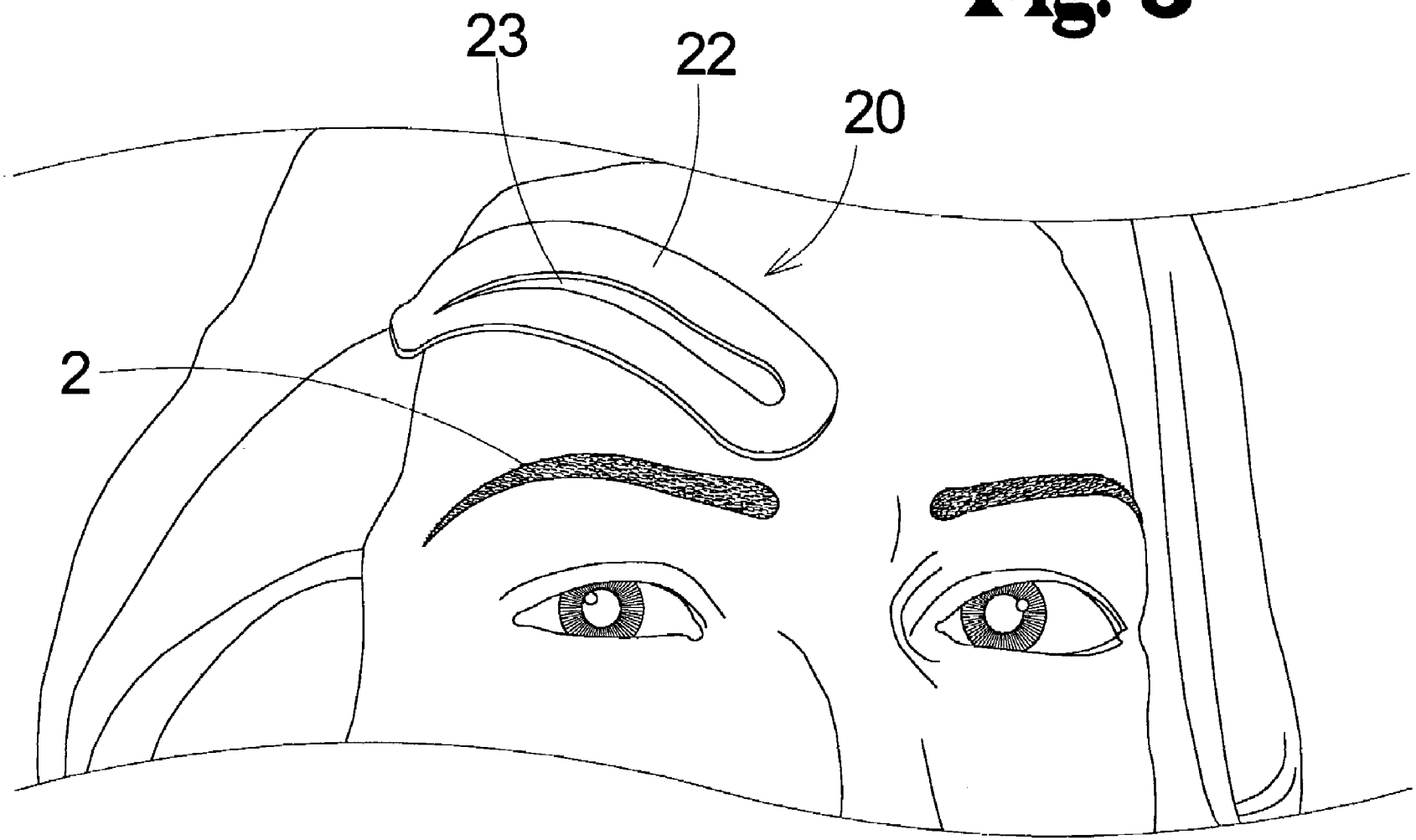
FIG. 3 is a schematic front view of the present invention.
Figure 4:
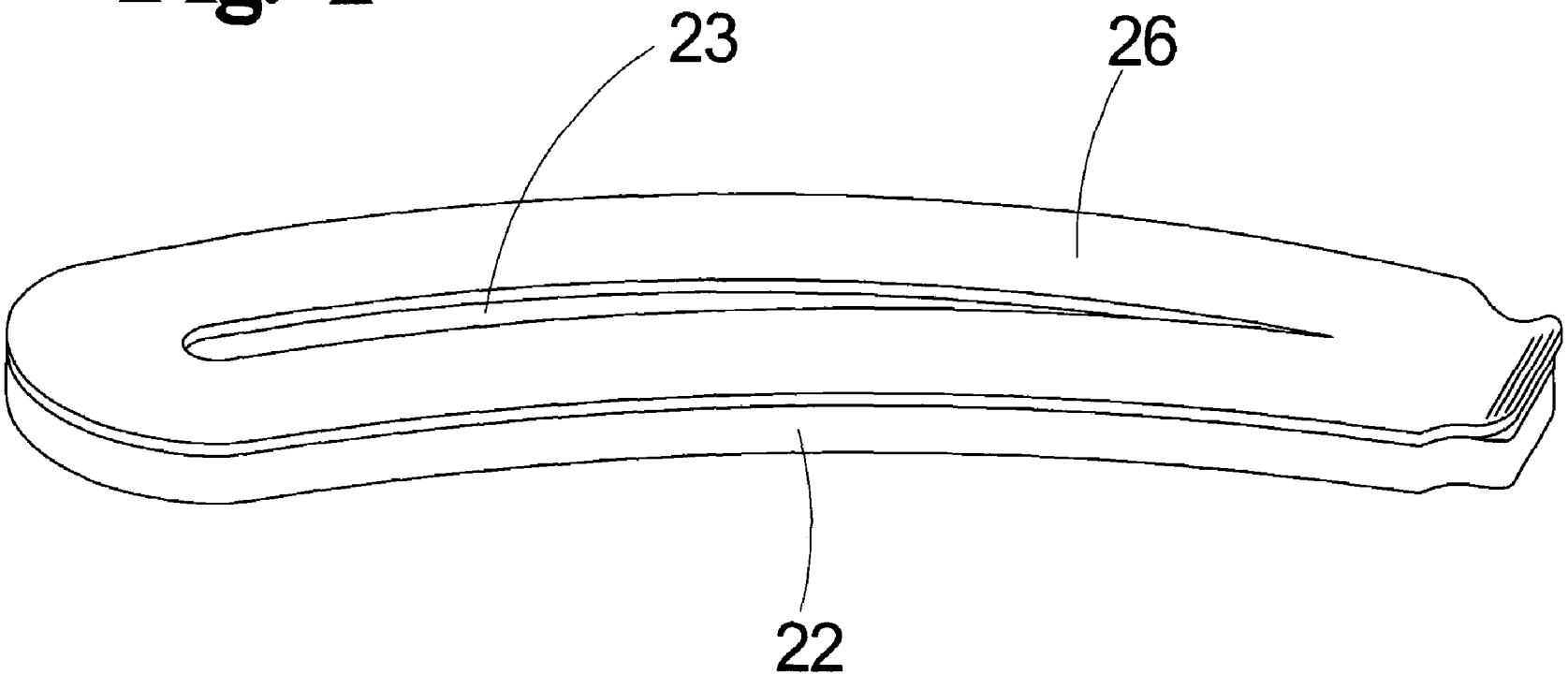
FIG. 4 is a schematic perspective bottom view of the present invention.
Figure 5:
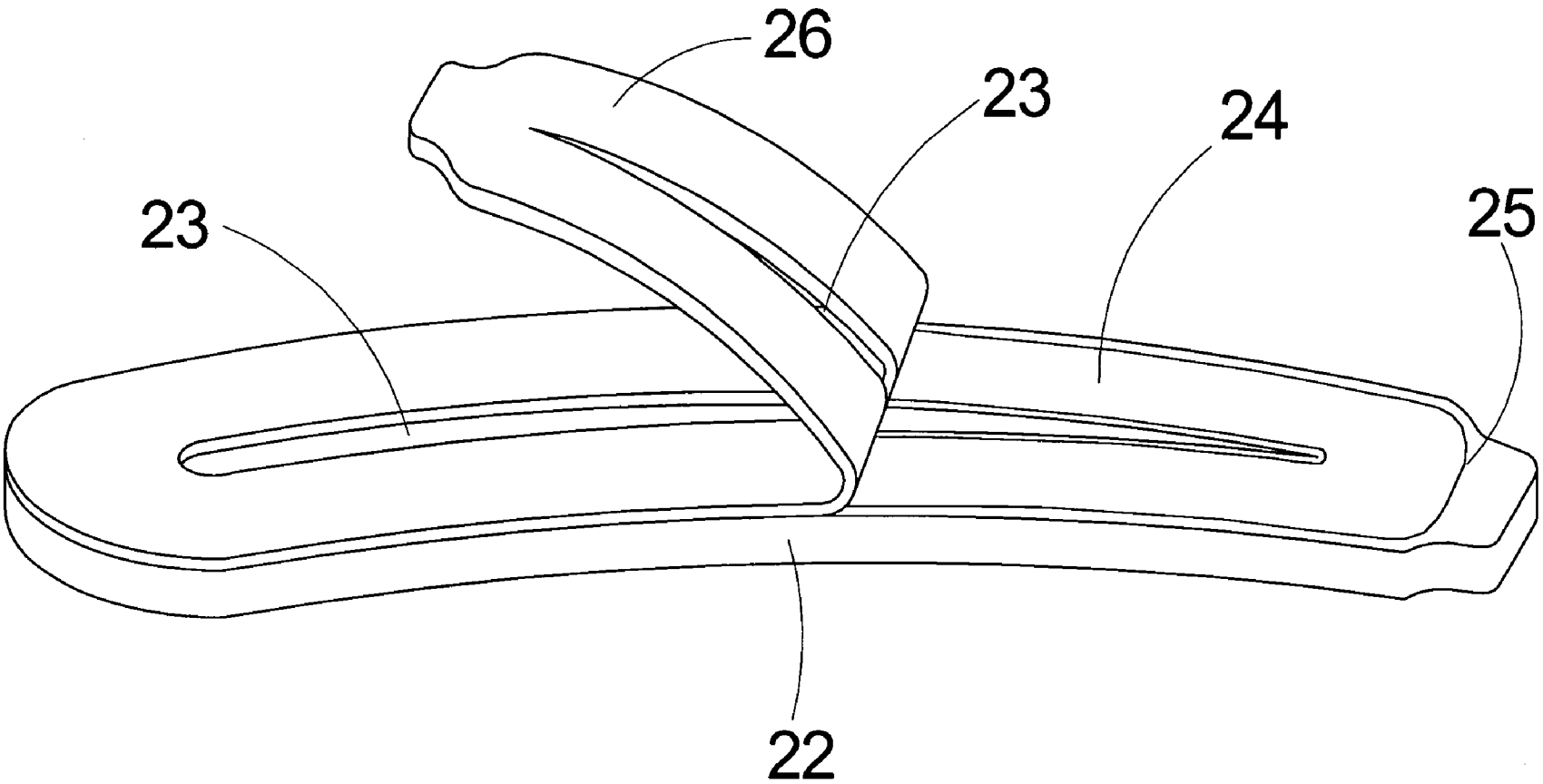
FIG. 5 is a schematic perspective view of the present invention with the protective portion partially removed.

With reference now to the drawings, and in particular to FIGS. 1 through 3 thereof, a new eyebrow shaping device embodying the principles and concepts of the present invention will be described.

As best illustrated in FIGS. 1 through 3, the eyebrow shaping device generally comprises a plurality of pairs of forms 20. Each pair of forms 20 having a right and a left member. Each one of said plurality of pairs having a uniquely associated brow shape defining a size and overall form for the eyebrows of the user.

In a preferred embodiment each one of said right and left members has a template portion 22, a substrate portion 24, and a protective portion 26. The template portion 24 has a cut-out area 23 which defines the overall shape and form of the eyebrow after use. The template portion 22 also has border area 25. The substrate portion 24 is positioned along a first surface of the boarder area 25. Preferable the substrate 24 is uniformly distributed along the first surface. The protective portion 26 is releasably coupled to the substrate portion 24 and protects the substrate portion 24 until the template portion 22 is used.

In a further embodiment the substrate portion 24 is a waxing material which is adapted for bonding to the eyebrow hair 2 and allows the unwanted hair 4 to be pulled free of the user thereby shaping the eyebrow 2.

In an alternate embodiment the substrate portion 24 is a hair dissolving substance which dissolves the unwanted hair 4 of the eyebrow 2 after a predefined period of contact with the unwanted eyebrow hair.

In use, the user selects the pair of forms to be used according to size and general shape. The user then selects the appropriate member of the pair, right or left, to begin use.

If a waxing substrate is used, then the user removes the protective portion from the substrate. The user then aligns and applies the member to the associated eyebrow. The user then rubs a second surface of the template portion applying pressure to the substrate facilitating bonding with the unwanted eyebrow hair. The user then abruptly removes the template from the eyebrow thereby pulling the unwanted hair free from the user and shaping the eyebrow. This process is then repeated using the second one of the pair of templates for the remaining eyebrow.

If a hair dissolving substrate is used, then the user removes the protective portion from the substrate. The user then aligns and applies the member to the associated eyebrow. The user then leaves the template in place against the eyebrow for a predetermined period of time allowing the substrate to dissolve the unwanted hair. Preferably, the predetermined time is 5 to 12 minutes. More preferably the predetermined time is 7 to 10 minutes. After the predetermined period has past the template is removed from around the eyebrow with the unwanted hair dissolved and the eyebrow shaped. This process is then repeated using the second one of the pair of templates for the remaining eyebrow.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of grooming eyebrows comprising:

providing a pair of forms, said pair of forms having a right member and a left member, each member of said pair of forms including an outer perimeter edge and an inner perimeter edge defining a cut-out area, a shape of the outer perimeter edge of each said member substantially corresponding to a shape of the inner perimeter edge of each said member, each one of said right and left members includes a template portion, a substrate portion, and a protective portion; said template portion having the cut-out area formed therein which defines the overall shape and form of the eyebrow after use, said template portion includes a border area, said substrate portion being positioned along a first surface of said boarder area, said protective portion being releasably coupled to said substrate portion, said protective portion protects said substrate until said template is used;

selecting a pair of forms having a desired shape;

removing said protective portion form a first one of said pair of selected forms;

positioning said first one of said pair of selected forms over a first eyebrow;

removing said protective portion form a second one of said pair of selected forms;

positioning said second one of said pair of selected forms over a second eyebrow;

removing said first one of said pair of selected forms from the first eyebrow;

removing said second one of said pair of selected forms from the second eyebrow;

providing a hair dissolving substrate being positioned along a first surface of said boarder area; and leaving each one of said templates in place against the eyebrow for a predetermined period of time facilitating said hair dissolving substrate dissolving unwanted hair;

wherein a removal tab is provided on an end of each member of said pair of forms.

2. An eyebrow grooming system for shaping and grooming eyebrows of a user comprising:

a pair of forms, each said pair of forms having a right member and a left member;

each pair of forms having a uniquely associated brow shape defining a size and overall form for the eyebrows of the user;

wherein each said member of said pair of forms includes an outer perimeter edge and an inner perimeter edge defining a cut-out area, and wherein a shape of the outer perimeter edge of each said member substantially corresponds to a shape of the inner perimeter edge of each said member;

wherein each one of said right and left members further comprises:

a template portion having the cut-out area formed therein which defines the overall shape and form of the eyebrow after use, said template portion includes a border area;

a substrate portion being positioned along a first surface of said boarder area;

a protective portion being releasably coupled to said substrate portion, said protective portion protects said substrate until said template is used;

wherein said the substrate portion being uniformly distributed along said first surface;

wherein said the substrate is a waxing material adapted for bonding to the eyebrow hair and facilitating unwanted hair to be pulled free of the user thereby shaping the eyebrow;

wherein said the substrate portion being uniformly distributed along said first surface;

wherein said substrate is a hair dissolving substance which dissolves unwanted hair of the eyebrow after a predefined period of contact with the unwanted eyebrow hair;

wherein said the substrate portion being uniformly distributed along said first surface;

wherein at least a portion of the outer perimeter edge of each said member of said pair of forms is curved; and wherein a removal tab is provided on an end of each member of said pair of forms.

* * * * *